US007100855B2

(12) United States Patent
Diemunsch

(10) Patent No.: US 7,100,855 B2
(45) Date of Patent: Sep. 5, 2006

(54) MODULAR BLADES FOR TIRE SHREDDER

(75) Inventor: Mark T. Diemunsch, Stockton, CA (US)

(73) Assignee: Barclay Roto-Shred Incorporated, Stockton, CA (US)

( * ) Notice: Subject to any disclaimer, the term of this patent is extended or adjusted under 35 U.S.C. 154(b) by 198 days.

(21) Appl. No.: 10/185,500

(22) Filed: Jun. 27, 2002

(65) Prior Publication Data

US 2004/0000606 A1 Jan. 1, 2004

(51) Int. Cl.
*B02C 18/18* (2006.01)

(52) U.S. Cl. ..... 241/236; 241/294; 241/300; 241/DIG. 31

(58) Field of Classification Search ..... 241/300, 241/294, 236, DIG. 31; 83/500–507
See application file for complete search history.

(56) References Cited

U.S. PATENT DOCUMENTS 4,776,249 A 10/1988 Barclay
4,854,508 A * 8/1989 Dicky ..... 241/236
4,871,119 A * 10/1989 Murata et al. ..... 241/189.1
4,901,929 A 2/1990 Barclay
5,318,231 A 6/1994 Bernhardt et al.
5,730,375 A * 3/1998 Cranfill et al. ..... 241/243
6,343,755 B1 2/2002 Barclay et al.

* cited by examiner

*Primary Examiner*—Mark Rosenbaum
(74) *Attorney, Agent, or Firm*—Schneck & Schneck; Thomas Schneck

(57) ABSTRACT

A cutter wheel for tire shearing having a unitary annular core with radially inward shoulders on both sides of the radially outward central portion of the core. Pie-piece shaped cutter segments are mounted atop the shoulders of each core with each cutter segment having a base and a blade atop the base, with cutter segments overlapping in a serrated fashion, beyond the central portion of the core. The central portion of the core is smooth, serving as a spacer between adjacent cutter segments. Each blade is split into two side-by-side blade segments, with the laterally outward blade segment experiencing greatest wear. The laterally inward blade segment mounted to a pie-piece shaped cutter segment by radial bolts, while the laterally outward blade segment is fastened to the laterally inward blade segment by axial bolts.

15 Claims, 5 Drawing Sheets

MODULAR BLADES FOR TIRE SHREDDER

TECHNICAL FIELD

The invention relates to tire shredding apparatus and, in particular, to cutting assemblies for such apparatus.

BACKGROUND OF THE INVENTION

Tire shredding machines are employed to reduce tires, particularly automotive tires, to small pieces of rubber which can be reused in manufacturing a variety of products. Several different machines are used to reduce tires, but most are rotary shredders of the type shown in U.S. Pat. No. 6,343,755 to Barclay and Diemunsch, incorporated by reference herein. In the first stage of tire reduction, a primary shredder is used to digest a whole tire and reduce the tire to oddly shaped pieces of rubber. From these oddly shaped pieces, rubber is subsequently reduced in secondary and tertiary shredders to finer and finer pieces of rubber until the rubber reaches the desired size, sometimes as fine as granular pellets or even small sawdust-like particles. However, the initial burden of tire reduction is placed on the primary shredder which must deal with the toughness and strength inherent in tire body construction.

In the early days of primary shredder construction, rotary shears were designed wherein a pair of counter-rotating, intermeshing, serrated cutting wheels, mounted on parallel rotating hubs or shafts, received a tire at a zone of intermeshing and proceeded to digest a tire by ripping the tire into strips which could pass between the wheels and be ejected after passage. The number of pairs of parallel cutting wheels on a single shaft or hub could vary, but usually more than six and less than twenty cutting wheels were placed on a single hub, with parallel wheels separated by spacers to allow intermeshing of another set of parallel wheels on another hub. A large number of parallel cutting wheels increases the size and number of tires which can be accepted into the machine for digestion.

Some strips of rubber would become jammed between adjacent cutting wheels during digestion and needed to be removed by a fixed tool, so that a clear zone of intermeshing would be presented to a tire upon rotation of the wheel. At the zone of intermeshing, a tire would encounter the outer periphery of counter-rotating cutting wheels. After continuous rotation for a period of time, the outer periphery of the cutting wheels would become worn, mainly at the outer periphery, by the toughness of tires and the wheel would need to be resurfaced. The problem of resurfacing cutting wheels has been addressed by several inventors. The above-mentioned '755 patent teaches that the outer peripheral contact region of a cutting wheel may be removed so that the entire cutting wheel need not be removed from its shaft for repair. Rather, by refinishing or replacing the outer contact region, a certain amount of modularity can be introduced which eases maintenance. The principle of modularity was extended by Bernhardt et al. in U.S. Pat. No. 5,318,231 wherein cutter wheels were provided with removable peripheral contact regions and adjacent wheels were laterally paired and joined on opposite sides of a spacer, in a sandwich construction. Now, each cutting wheel is actually a pair of wheels, separated by a spacer wheel, in relation to a shaft on which the wheels are mounted. This facilitates maintenance and assembly of both cutting surfaces and the wheels themselves. Paired cutting wheels are accurately spaced in relation to each other.

In summary, the prior art recognizes that wear in cutting wheels occuring at outer periperal surfaces contacting tires to be shred can be offset by removing and replacing or refinishing the outer wear surfaces, thereby obviating the need to remove an entire cutting wheel and facilitating maintenance. The prior art also recognizes that modularity may be employed not only by providing replaceable cutting surfaces, but also in wheel construction by pairing cutting wheels with an intermediate spacer wheel in a sandwich construction. An object of the invention was to facilitate maintenance in cutting wheels of rotary shearing apparatus by improving modular construction of cutting wheels.

SUMMARY OF THE INVENTION

The above object has been achieved in a rotary shearing apparatus which provides double and triple modularity in replaceable cutters. However, rather than provide modularity or redundancy in a sandwich construction for cutter wheels, involving pairing of cutter wheels on opposite sides of a spacer wheel, as in the prior art, the present invention provides a cutter wheel having unitary core with a radially extensive central portion and less extensive lateral shoulders. The unitary core serves as a precision means for separating serrated disk-shaped cutting assemblies. Unlike the prior art where a spacer wheel had its own tolerance considerations, the integral core has no such tolerances over much of its radius. Atop the lateral shoulders of the core, truncated pie-piece cutter segments are removably mounted. Each cutter segment is modular, having a base removably mounted to the core and a blade removably mounted atop the base, thereby providing double modularity in the cutter construction. The assembly resembles the sandwich construction for cutter wheels, but the construction is different, having only a single unitary core to be driven by a hub and rotating shaft. The pie-piece cutter segments, formed of base and blade, extend radially outwardly beyond the central portion of the core so that the central portion is a spacer between a pair of cutter segment arrangements atop shoulders of the core.

Modularity may be extended one step further by splitting the blade into laterally inwardly and outwardly facing members in relation to the central portion of the unitary core. The laterally inwardly facing member is larger than the laterally outwardly facing blade member so that it can carry radially extending recessed bolts anchoring the blade to its base. Only the top surface of the inwardly facing member experiences wear because the core protects most of the inward face. The laterally outwardly facing member is smaller and cheaper to manufacture but experiences most wear because it has a shearing edge, as well as exposed top and lateral surfaces. The outwardly facing smaller member resembles a small rectangular bar of metal and is fastened to the larger inwardly facing blade member by recessed axial bolts which do not interfere with the radially extending bolts of the outwardly facing blade member. By splitting the blade into two members, modularity is extended even further and maintenance is facilitated by allowing the blade surface experiencing the most wear to be replaced by a small piece or bar of steel.

DESCRIPTION OF THE PREFERRED EMBODIMENT

Figure 1:
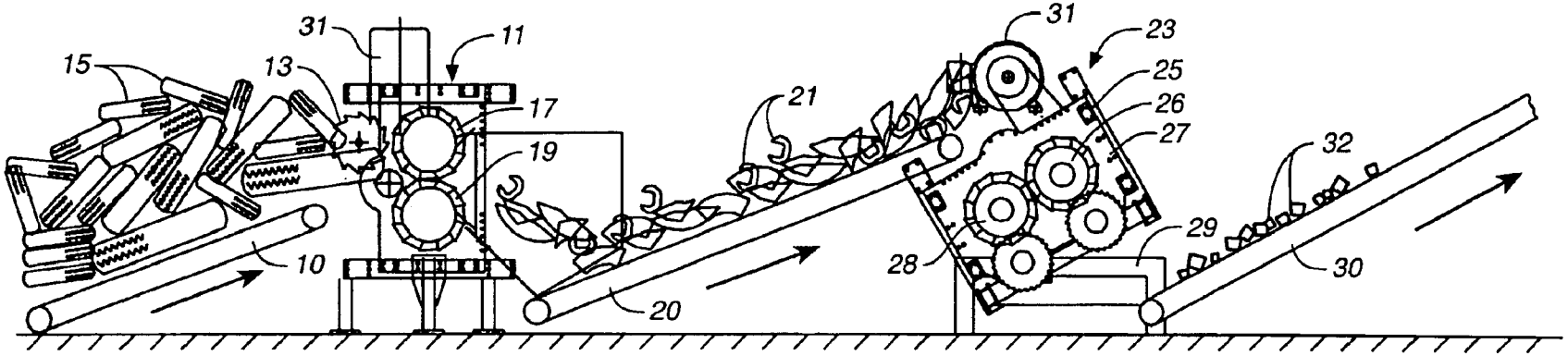
FIG. 1 (PRIOR ART)
FIG. 1 is a side elevational view of typical tire shredding machinery of the prior art.

With reference to FIG. 1, a typical tire reduction system of the prior art is seen, as described in the previously mentioned '755 patent. A continuous feed of tires 15, is placed on conveyor belt 10 for motion toward the primary rotary shearing assembly 11. A toothed feeder wheel 13 seizes tires from the conveyor belt and pushes them into the primary shearing assembly 11 for digestion. The primary shearing assembly, relying on the rotary shears 17 and 19, reduces full tires to several 42 inch strips 21, depending on the number of rotary shears, each of which is typically 6 inches wide at the shearing blade, such that at least 6 shearing wheels plus spacers would be needed to span the diameter of an average tire. A second conveyor belt 20 moves the tires to secondary shearing assembly 23. Here, a pair of secondary rotary shears 26 and 28, mounted within box 27, held by support rails 29, receives the various length strips from bin 25. The secondary shearing assembly 23 reduces the pieces 32, falling onto conveyor belt 30, typically ranging in size between 1.5 inches and 4 inches. Electric motor 31 provides the force for driving the primary and secondary shears simultaneously in tandem.

Figure 2:
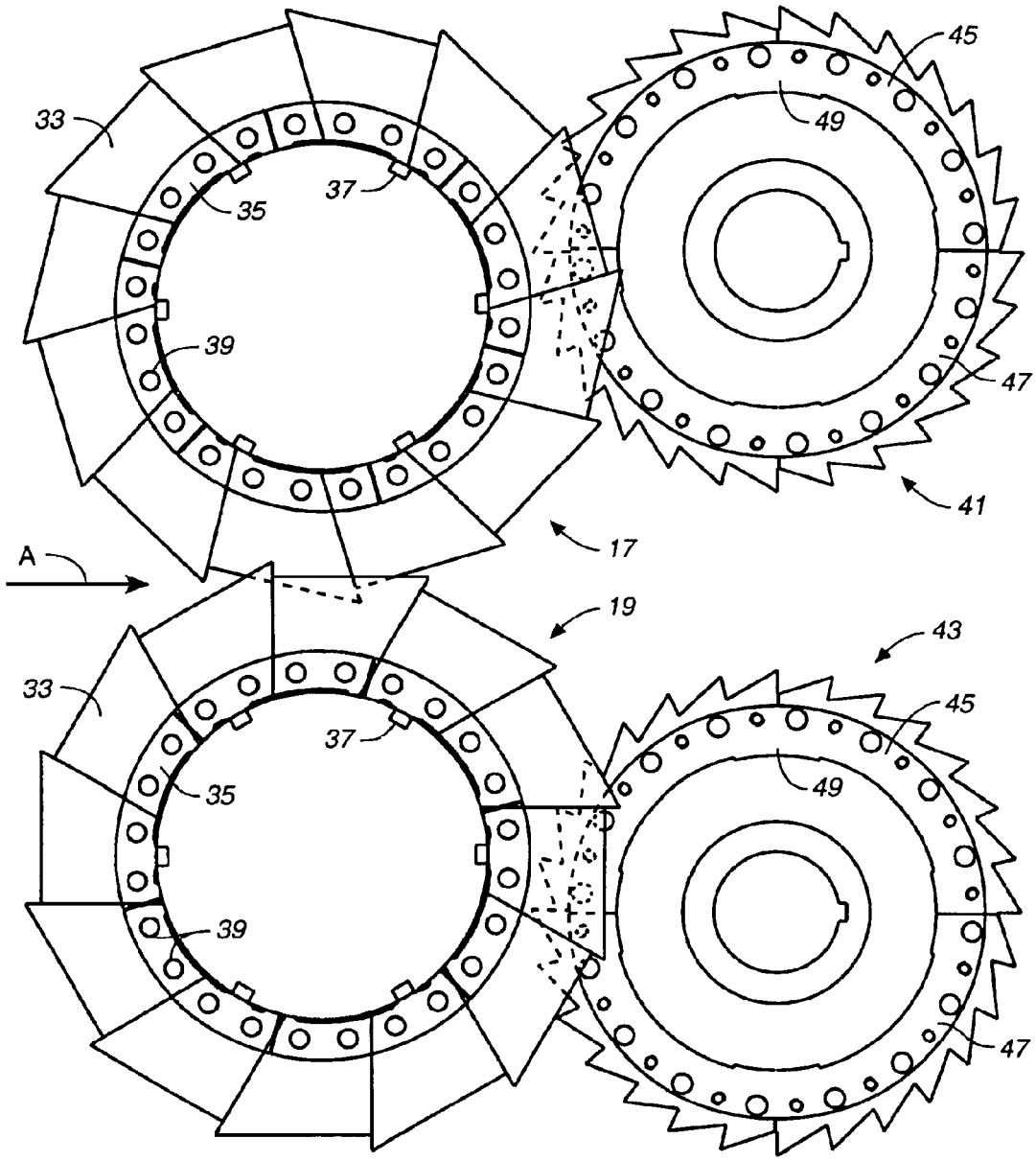
FIG. 2 (PRIOR ART)
FIG. 2 is a side plan view of a pair of intermeshing, adjacent cutter wheels of a primary tire shredder, in an operative tire shearing relation, as found in the prior art, with a pair of stripper rolls of the prior art positioned for removing tire comminution debris from spaces between adjacent cutter wheels.

In FIG. 2, detailed operation of primary shearing wheels of a rotary shearing assembly of FIG. 1 is seen. A first shearing wheel 17 is shown meshing with a second shearing wheel 19. Each shearing wheel is mounted on a drive shaft and has shearing members 33 mounted adjacent to an annular non-unitary spacer 35, separating the cutter assembly from an adjacent cutter assembly. The annular spacer may be segmented and is driven by a drive shaft or hub by key members 37. Bolts joining the annular spacer to the cutter assembly allow the shearing members to be individually removed from each shearing wheel for resharpening, following the teachings of U.S. Pat. No. 4,901,929 to R. Barclay. First and second sets of shearing assemblies mounted on respective shafts in interleaving relationship act as rotary shears for tires fed between the assemblies in the direction of arrow A. The stripper rolls 41 and 43 clear the spaces between spaced apart shearing members of each shearing wheel 17 and 19. Arcuate steel segments 45 and 47 in each roll are side mounted to a separate annular member 49 for ease of maintenance as described in U.S. Pat. No. 4,776,249 to R. Barclay. Among other features, the present invention integrates the annular spacers with a shearing wheel body, in a unitary body, as described below.

Figure 3:
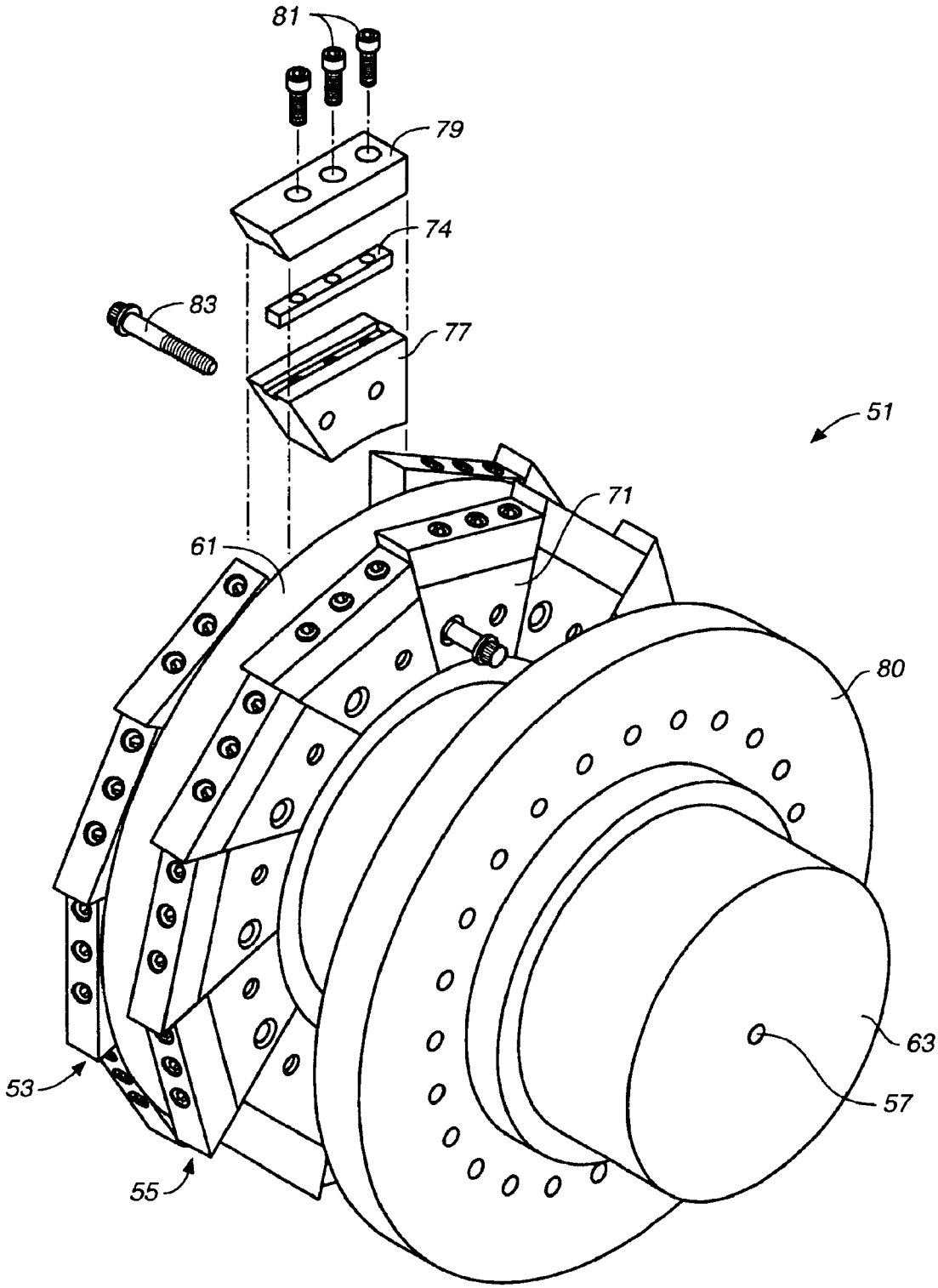
FIG. 3 is an exploded perspective view of a single cutting assembly of a primary shredder of the present invention, intended to mesh with a similar cutting assembly in a tire shearing relation.

With reference to FIG. 3, a rotary shear 51 of a primary shredder is shown to have a cutting wheel with cutting assemblies 53 and 55 mounted on a hub 63 having a central longitudinal axis 57 with which the cutting wheels are concentric. Hub 63 rotates about axis 57. Between the cutting assemblies is a core 61 which serves as a spacer between cutting assemblies 53 and 55. The periphery of the spacer is smooth and is slightly recessed compared to the periphery of the cutting wheels. The cutting assemblies have a serrated circumferential profile which arises from segments 71 which are pie-piece shaped, except that the segments slightly overlap each other, creating a serrated profile. Each segment has a base 77 with a blade 79 atop the base and circumferentially aligned with the base by means of an alignment key 74, contacting both the base 77 and the blade 79. The alignment key 74 allows a blade to be used on two sides and also serves to keep blades from sliding. Radially extending bolts 81 hold the blade 79 to base 77 while axial bolts 83 hold the pie-piece segment to the core 61. An end plate 80 may be seen at one end of hub 63. Although not shown, the end plate is preferably equipped with peripheral blades for engaging an adjacent shearing wheel in a shearing relationship. All axial bolts are secured to the end plate. There are sufficient rotary shears on each hub to span the width of a tire.

Figure 5:
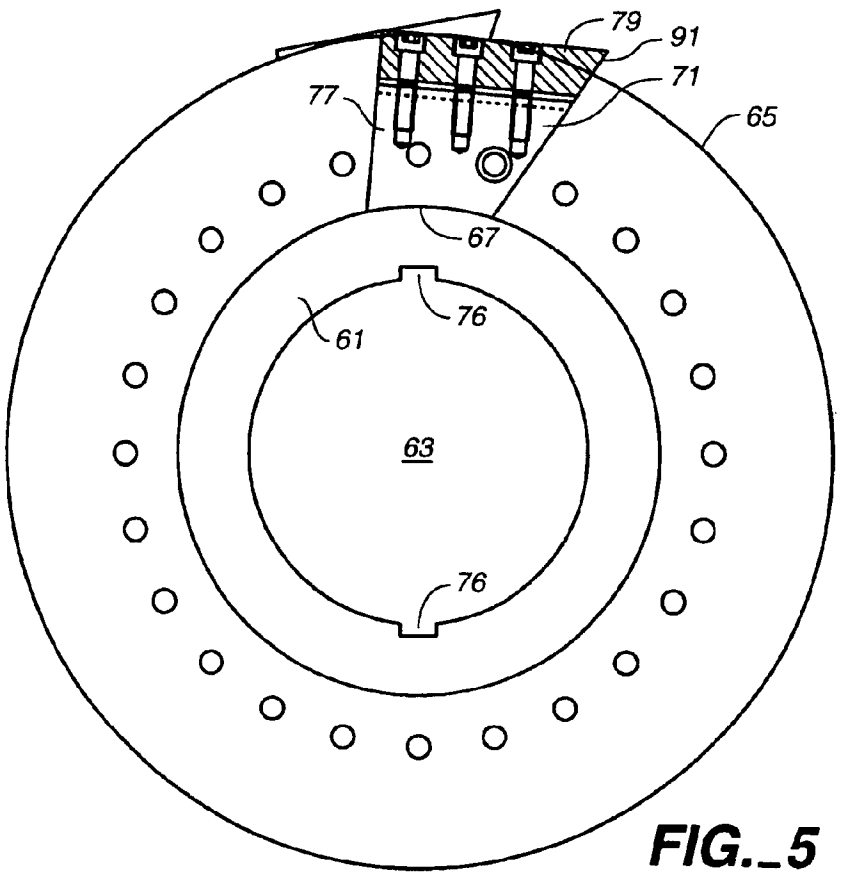
FIG. 5 is a side view of the apparatus of FIG. 4.
Figure 4:
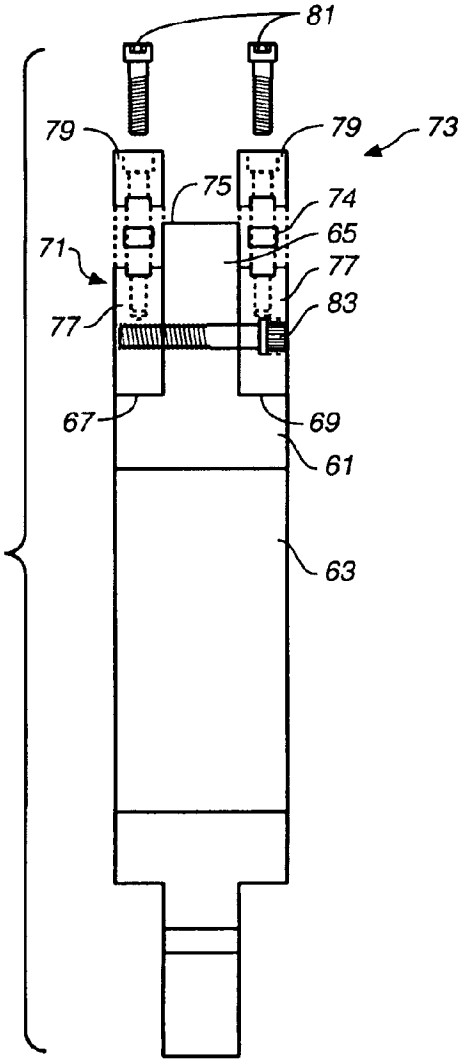
FIG. 4 is an exploded front elevational view of a single cutting wheel illustrated in FIG. 1.

With reference to FIGS. 4 and 5, the core may be seen to have a central portion 75 and lateral shoulders 67 and 69 which are radially inward compared to central portion 75 which extends radially outwardly almost as far as the outer extent of the pie-piece segments. The shoulders 67 and 69 support cutter wheel segments, specifically bases 77, to which the blades 79 are fastened by means of radial bolts 81. Axial bolts 83 fasten the pie-piece segments to central portion 75 of core 61. Core 61 is annular, residing on hub 63. Core 61 slides onto hub 63 and is driven by protrusions 76 on hub 63, visible in FIG. 5. When the outwardly facing sides of the bases and blades show wear, the bases may be exchanged about the core so that the formerly inwardly facing sides are now outwardly facing.

In FIG. 5, the smooth circumferential perimeter of the central portion 65 may be seen. The radially outward extent of the central portion is seen to be a circle having a diameter which is tangent to the blade 79, leaving a forward edge exposed for clawing or ripping into tires with which the blade 79 comes into contact. However, the pie-piece segments 71 are on opposed lateral shoulders 67 and 69 of core 61 (FIG. 4) so that each cutting wheel appears to be a pair of cutting wheels separated by a spacer. Of course, this is not the case, since the core 61 is unitary and the pie-piece segments 71 carried on each shoulder of core 61 make it appear as if two separate cutting wheels were separated by a central spacer. This facilitates maintenance because at the time pie-piece segments are entirely replaced or refurbished, only a single wheel or single pie-piece segment or single blade needs to be removed from the hub, yet two radial cutting surfaces are carried by a single wheel.

Blade bases 77 are made of heat-treated D-2 tool steel. Similarly, the blade members 79 are also heat-treated D-2 tool steel. In FIG. 3, twelve pie-piece segments are circumferentially disposed on each shoulder next to a core of a cutting wheel. In operation, pairs of wheels of the type shown in FIG. 3 intermesh with blades of opposed wheels approaching each other in a shearing relationship. This means that blades of each wheel approach a central portion of a core of an opposed wheel and engage blades of an intermeshing wheel in a shearing relation. For this reason, the central portion of each core should have the same width as a blade. However, cut widths can be varied depending on the thickness of the core and the thickness of the blade. The core and blade dimensions can vary to produce different size cuts.

Figure 6:
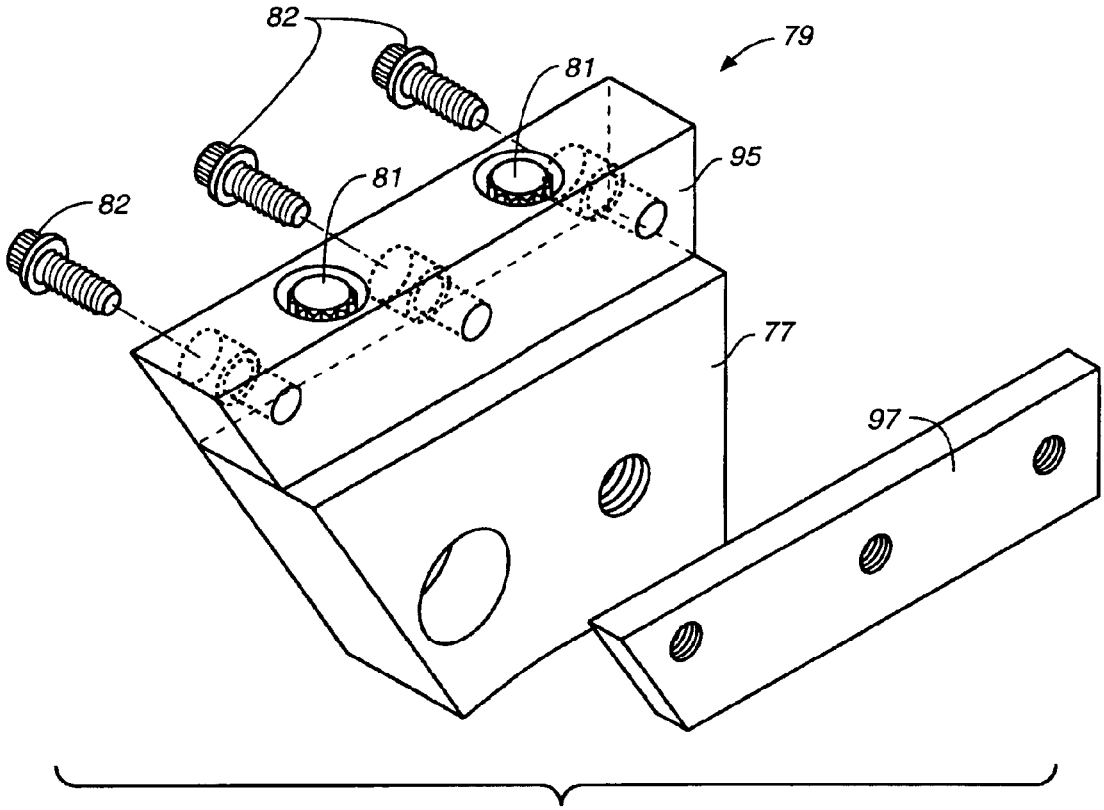
FIG. 6 is an alternate embodiment of a cutter segment capped by a two-piece blade in accordance with the present invention.

In FIG. 6, it is seen that each blade is split, with an inwardly facing blade member 95 which is mounted against the central portion of a core and an outwardly facing blade member 97 distal from the core, compared to blade member 95. The thickness of the outwardly facing member is less than half of the thickness of the inwardly facing blade member. Preferably, the overall thickness of the entire blade is 1.5 inches, while the thickness of the outwardly facing blade member 97 is ⅜ inches, but these values are variable and not critical. The outwardly facing blade member 97 is made of D-2 tool steel and since blade member 97 experiences the most wear, it is easily replaceable. To replace the outwardly facing blade member 97, the entire blade 79 must be removed by first removing radial bolts 81. Once these are removed, the axial bolts 82 may be removed, thereby releasing the outwardly facing blade member 97. Bolts 81 and 82 have heads that are recessed into the inwardly facing blade member 95. Although not shown, an alignment key may be used to help support the inwardly facing segment.

The ability to change the outwardly facing blade member, i.e. a fraction of the mass of the entire blade member 79, is a substantial cost savings considering the number of blades which are employed. An outwardly facing blade member is preferably made of a tougher, but more expensive material, usually a grade of tool steel, such as D2. The inwardly facing blade member may be a less tough and inexpensive material. Eventually, the inwardly facing blade member 95, as well as the replaceable base 77 will need to be refinished or replaced. However, greatest wear is on the exposed outwardly facing blade member which needs refinishing or replacement more frequently.

What is claimed is:

1. A shredder for reducing tires to rubber chunks comprising, intermeshing rotary shears, each shear having a plurality of cutting wheels on parallel axes, each wheel having an axially rotatable core rotationally driven by an axially extending hub, the core having a radially extensive central portion and with radially less extensive lateral shoulders on opposite sides of the central portion, a plurality of inwardly truncated pie-piece shaped segments supported by the shoulders and fastened to the central portion of the core and whose outer periphery extends beyond the radially extensive central portion as a pair of serrated disks, the outer periphery of each segment capped by a removable two-piece blade, each blade having a removable outwardly facing blade member and an inwardly facing blade member to which the outwardly facing blade member is fastened, the combined width of the blade members approximately equal to the width of a pie-piece segment, whereby shearing action between intermeshing cutting wheels occurs at least between the outwardly facing removable blade members.

2. The apparatus of claim 1 wherein each inwardly facing blade member is fastened to a base by radially extending bolts and wherein each outwardly facing blade member is fastened to an inwardly facing blade member by non-interfering axially extending bolts whereby blades may be replaced without denouncing of pie-piece shaped segments.

3. The apparatus of claim 2 wherein said pie-piece shaped segments are fastened to said core by axially extending bolts.

4. The apparatus of claim 1 wherein the outwardly facing blade member has the same cross-sectional shape as the inwardly facing blade member.

5. The apparatus of claim 4 wherein the outwardly facing blade member has a thickness which is less than half the thickness of the inwardly facing blade member.

6. A shearing tool for a rotary shear comprising, an axially rotating hub carrying annular cutters for shearing of tires against a similarly rotating hub, each cutter having a plurality of two piece blades at an outer periphery of each annular cutter, the blades having a first top segment working against the similarly rotating hub and a side-by-side relation to a second segment, whereby the side-by-side first and second segments are independently replaceable from a cutter.

7. The apparatus of claim 6 wherein the first blade segment is joined to the second blade segment by axially extending bolts.

8. The apparatus of claim 6 wherein the second blade segment is joined to an annular cutter by radially extending bolts.

9. The apparatus of claim 6 wherein the thickness of the first blade segment is less than half the thickness of the second blade segment.

10. The apparatus of claim 6 further defined by a plurality of bases joined to the annular cutters in an annular pattern, the bases carrying the blade segments.

11. The apparatus of claim 10 wherein the bases have truncated pie-piece shapes.

12. The apparatus of claim 11 wherein the bases are joined to the cutters by axial bolts and wherein the bases receive radial bolts from at least one of the blade members.

13. In a shearing tool for a rotary shear of the type having an axially rotating hub carrying annular cutters for shearing tires against a similarly rotating hub, the improvement comprising, a two-piece blade radially outward of the axially rotating hub and mounted on a support with a first circumferential removable blade segment working against a similarly rotating hub and a second circumferential removable blade segment in side-by-side relation to the first segment.

14. The apparatus of claim 13 wherein one of the first and second removable blade segments is mounted to the support by radially extending bolts and the other of the blade segments is mounted to the one by axially extending bolts.

15. The apparatus of claim 13 wherein said two-piece blade is one of a number of first circumferentially disposed blades mounted to a first side of the support with second circumferentially disposed blades mounted on a second side of the support in a spaced apart relation relative to the first circumferentially disposed blades.

* * * * *